US008197045B2

(12) United States Patent
Takeuchi

(10) Patent No.: US 8,197,045 B2
(45) Date of Patent: Jun. 12, 2012

(54) INK CONTAINER COMPRISING AN INK PACK AND IMAGE FORMING APPARATUS INCORPORATING THE INK CONTAINER

(75) Inventor: Shotaro Takeuchi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 481 days.

(21) Appl. No.: 12/416,204

(22) Filed: Apr. 1, 2009

(65) Prior Publication Data

US 2009/0256892 A1 Oct. 15, 2009

(30) Foreign Application Priority Data

Apr. 14, 2008 (JP) ..... 2008-104347

(51) Int. Cl.
*B41J 2/175* (2006.01)
*B65D 33/06* (2006.01)
*B65D 33/14* (2006.01)

(52) U.S. Cl. ..... 347/86; 383/20; 383/26

(58) Field of Classification Search ..... 347/86; 383/20, 26

See application file for complete search history.

(56) References Cited

U.S. PATENT DOCUMENTS 5,666,146 A * 9/1997 Mochizuki et al. ..... 347/86
5,691,755 A 11/1997 Pawlowski, Jr. et al.
2001/0024225 A1* 9/2001 Ishizawa et al. ..... 347/86
2002/0089576 A1 7/2002 Ishizawa et al.
2002/0093556 A1 7/2002 Ishizawa et al.
2005/0152620 A1* 7/2005 Diplock ..... 383/20
2005/0243148 A1 11/2005 Miyazawa et al.
2010/0283821 A1 11/2010 Ishizawa et al.

FOREIGN PATENT DOCUMENTS

EP 0678390 A2 10/1995
EP 1555128 A1 7/2005
JP 60-32671 2/1985
JP 2001-105619 4/2001
JP 2001219572 A * 8/2001
JP 2007-111864 5/2007

OTHER PUBLICATIONS

Jun. 12, 2010 Chinese official action in connection with a counterpart Chinese patent application.
Mar. 6, 2012 European search report in connection with counterpart European patent application No. 09 25 0856.

* cited by examiner

*Primary Examiner* — Shelby Fidler
(74) *Attorney, Agent, or Firm* — Cooper & Dunham LLP

(57) ABSTRACT

An ink container incorporatable in an image forming apparatus includes an ink pack formed by adhering perimeters of multiple flexible films together to contain ink therein, the ink pack having at least one hole formed in a perimeter thereof and a case to hold the ink pack therein, formed by fitting together multiple members. A first member of the multiple members has a projecting portion insertable into the at least one hole formed in the ink pack. A second member of the multiple members has a recessed portion with a slot shape arranged to which the projecting portion of the first member corresponds. The multiple member are fit together by slidably moving the projecting portion of the first member to the recessed portion of the second member in a longitudinal direction of the case.

13 Claims, 6 Drawing Sheets

INK CONTAINER COMPRISING AN INK PACK AND IMAGE FORMING APPARATUS INCORPORATING THE INK CONTAINER

TECHNICAL FIELD

This disclosure relate to an ink container and an image forming apparatus incorporating the ink container, and more particularly, to an ink container including an ink pack formed by multiple flexible films for containing ink therein and a case formed by multiple members to hold the ink pack therein, and an image forming apparatus incorporating the ink container.

BACKGROUND

Image forming apparatuses, such as copiers, printers, facsimile machines, or multifunction printers having at least one of copying, printing, scanning, and facsimile functions, typically form an image on a recording medium (e.g., a sheet) by a liquid discharging method. Thus, for example, a liquid discharging head discharges liquid (e.g., an ink droplet) onto a conveyed sheet, and the liquid is then adhered to the sheet to form an image on the sheet.

Such image forming apparatuses generally employ either a serial-type image forming apparatus or a line-type image forming apparatus.

A serial-type image forming apparatus feeds recording media of paper intermittently in a sub-scanning direction, and, when the recording media are stopped, moves a recording head, which includes the liquid discharging head thereon, on the recording media in a main scanning direction perpendicular to the sub-scanning direction. In the serial type image forming apparatus, a recording head is mounted on a carriage that moves reciprocally along a guide rail disposed perpendicular to a direction in which the recording medium is transported, and recording is carried out while reciprocating the recording head along the guide rail.

By contrast, in the line-type image forming apparatus, a recording head that is as wide as the recording medium is disposed in a direction perpendicular to the direction in which the recording medium is transported, and recording is carried out line by line.

These image forming apparatuses employ ink cartridges to store ink for supplying the ink to the recording head. These ink cartridges are of various types, as described below.

One proposed type of an ink cartridge includes a cartridge case and an ink bag accommodated in the cartridge case. The cartridge case has an opening formed corresponding to an opening formed on the ink bag. A ring-shaped projecting portion that projects outward from an outer surface of a perimeter of the opening of the case is formed around the opening of the case. The outmost part of the opening of the case is positioned relatively outward from a leading edge of the opening of the ink bag.

The ink cartridge of this proposed approach is assembled by one ink pack with ink therein, two cartridge cases, and two screws by slidably fitting the two cases together and fixing with the two screws only. Therefore, even if the ink cartridge with a certain amount of ink contained in the ink bag falls, the configuration gives relatively small damage to the case, and thereby prevents ink leakage from the ink bag containing the ink therein. Further, the configuration does not employ a snap-fit mechanism, which can expect high reusability.

However, the ink cartridge of this proposed approach may increase an amount of ink contained in the ink bag. When an ink cartridge is made relatively large and heavy due to an increase in amount of ink and when an ink cartridge falls from a higher place to give a greater impact force to the ink cartridge, the impact can wobble the ink pack in the case, which can result in damage to the ink pack to cause ink leakage.

Another proposed approach of an ink cartridge provides an ink cartridge including a rigid case accommodating an ink pack formed by adhering respective perimeters of flexible films together.

The rigid case includes a recessed portion and a rib. The recessed portion corresponds to a cross section of the ink pack raised to a pillow-like shape due to ink filled therein. The rib is formed to nip the perimeter of the ink pack. The recessed portion maintains the ink pack in a substantially constant shape to prevent high deformation due to vibration and/or fall, and the rib positions and fixes the ink pack in the rigid case. According to this configuration, the ink pack can be removed easily by detaching the rigid case from the ink cartridge.

However, since the ink cartridge of this proposed approach cannot slidably fit the two cases together, if the ink cartridge becomes relatively large and heavy due to an increase in amount of ink and if the ink cartridge falls from a higher place and receives a greater impact force, the two cases may need to be more fixedly adhered to each other and need additional screws, which can increase manufacturing costs. In addition, an increase in claws used for engaging the two cases may increase steps or processes in preparing for reusing the ink cartridge.

To enable multiple printing for one replacement, there is market demand for an ink container capable of containing a large amount of ink. It is preferable that such ink container is collected for reuse for maintenance of global environment purposes.

SUMMARY

In an aspect of this disclosure, there is provided an ink container having high resistance to impact, thereby being capable of containing a large amount of ink and highly reusable.

In another aspect, there is provided an image forming apparatus that incorporates the above-described ink container.

In one exemplary embodiment, an ink container includes an ink pack formed by adhering perimeters of multiple flexible films together to contain ink therein, the ink pack having at least one hole formed in a perimeter thereof, and a case to hold the ink pack therein, formed by fitting together multiple members. A first member of the multiple members has a projecting portion insertable into the at least one hole formed in the ink pack. A second member of the multiple members has a recessed portion with a slot shape arranged at a position corresponding to the projecting portion of the first member. The multiple members are fit together by slidably moving the projecting portion mounted on the first member to the recessed portion arranged on the second member in a longitudinal direction of the case.

The ink pack may include multiple edges on the perimeter. A first edge of the multiple edges may have an opening therein to discharge ink. A second edge of the multiple edges may have a hole therein. The projecting portion of the first member of the case and the recessed portion of the second member of the case may be formed on positions corresponding to the hole formed in the second edge of the ink pack.

The multiple edges of the ink pack may include four edges that have the opening and the second edge having the hole disposed facing each other.

The above-described ink container may further include a reinforcing member having an annular plate shape, being disposed on an upper film of the flexible films on the perimeter in the vicinity of the hole of the ink pack.

The above-described ink container may further include a reinforcing member having an annular plate shape, being sandwiched between the flexible films on a perimeter of the hole of the ink pack.

Further, in one exemplary embodiment, an image forming apparatus includes the above-described ink container, and a cartridge holder holding the ink container.

BRIEF DESCRIPTION OF THE DRAWINGS

The aforementioned and other aspects, features and advantages would be better understood by reference to the following detailed description when considered in connection with the accompanying drawings, wherein.

DETAILED DESCRIPTION OF EXEMPLARY EMBODIMENTS

Figure 1:
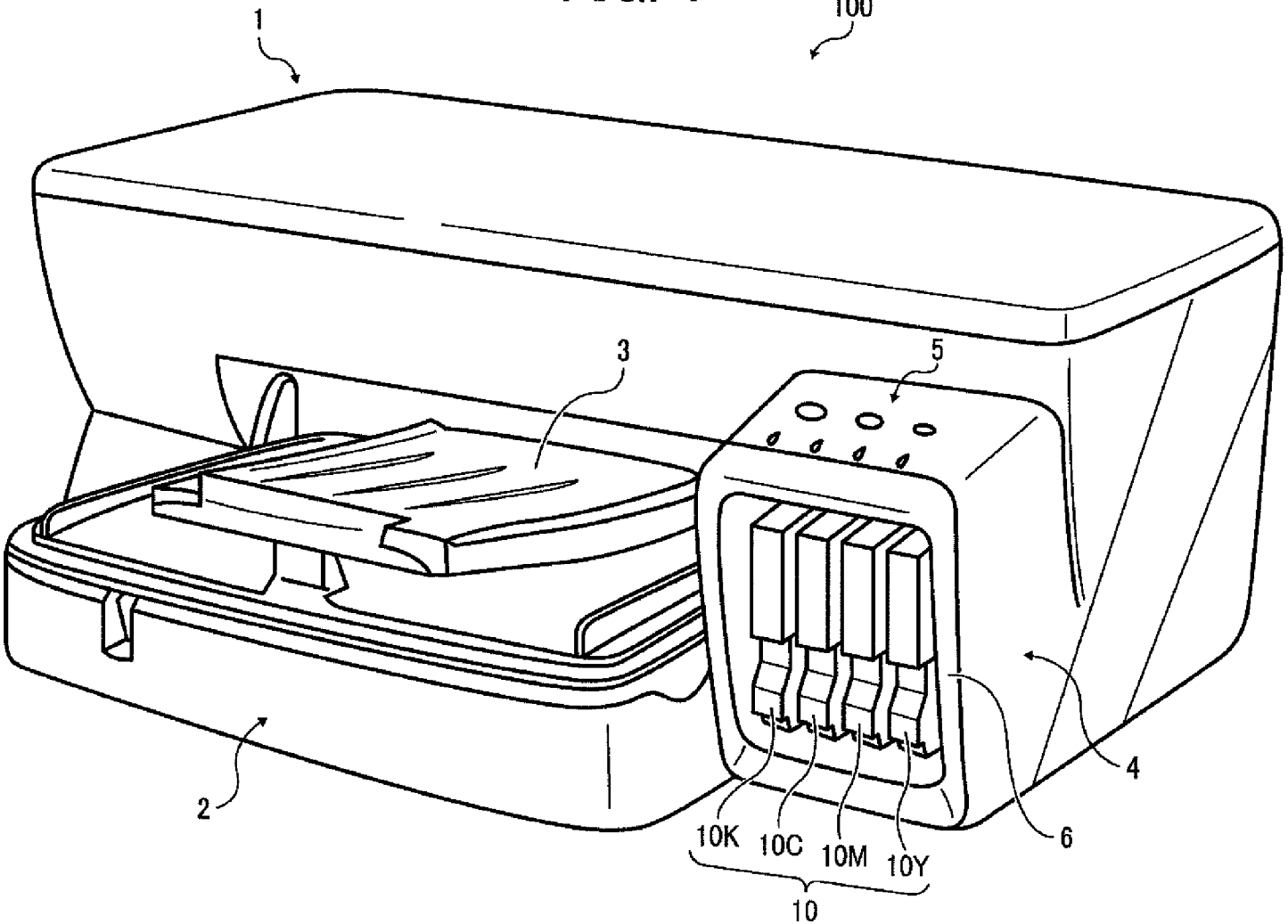
FIG. 1 is a schematic configuration of an image forming apparatus according to an exemplary embodiment of the present patent specification.

In describing exemplary embodiments illustrated in the drawings, specific terminology is employed for the sake of clarity. However, the disclosure of the present patent specification is not intended to be limited to the specific terminology so selected and it is to be understood that each specific element includes all technical equivalents that operate in a similar manner.

Figure 2:
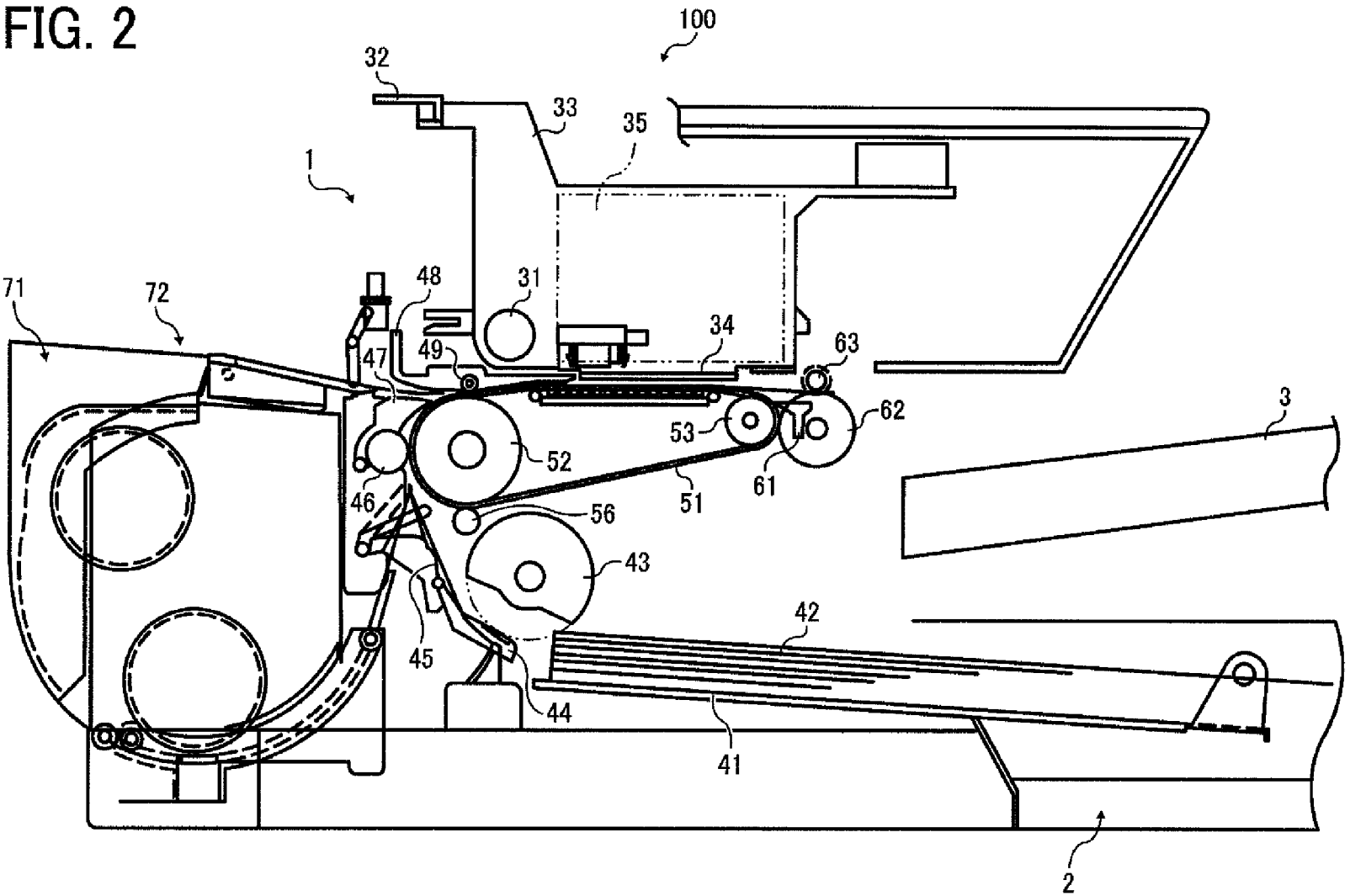
FIG. 2 is a side view illustrating a schematic structure of an image forming device of the image forming apparatus of FIG. 1.
Figure 3:
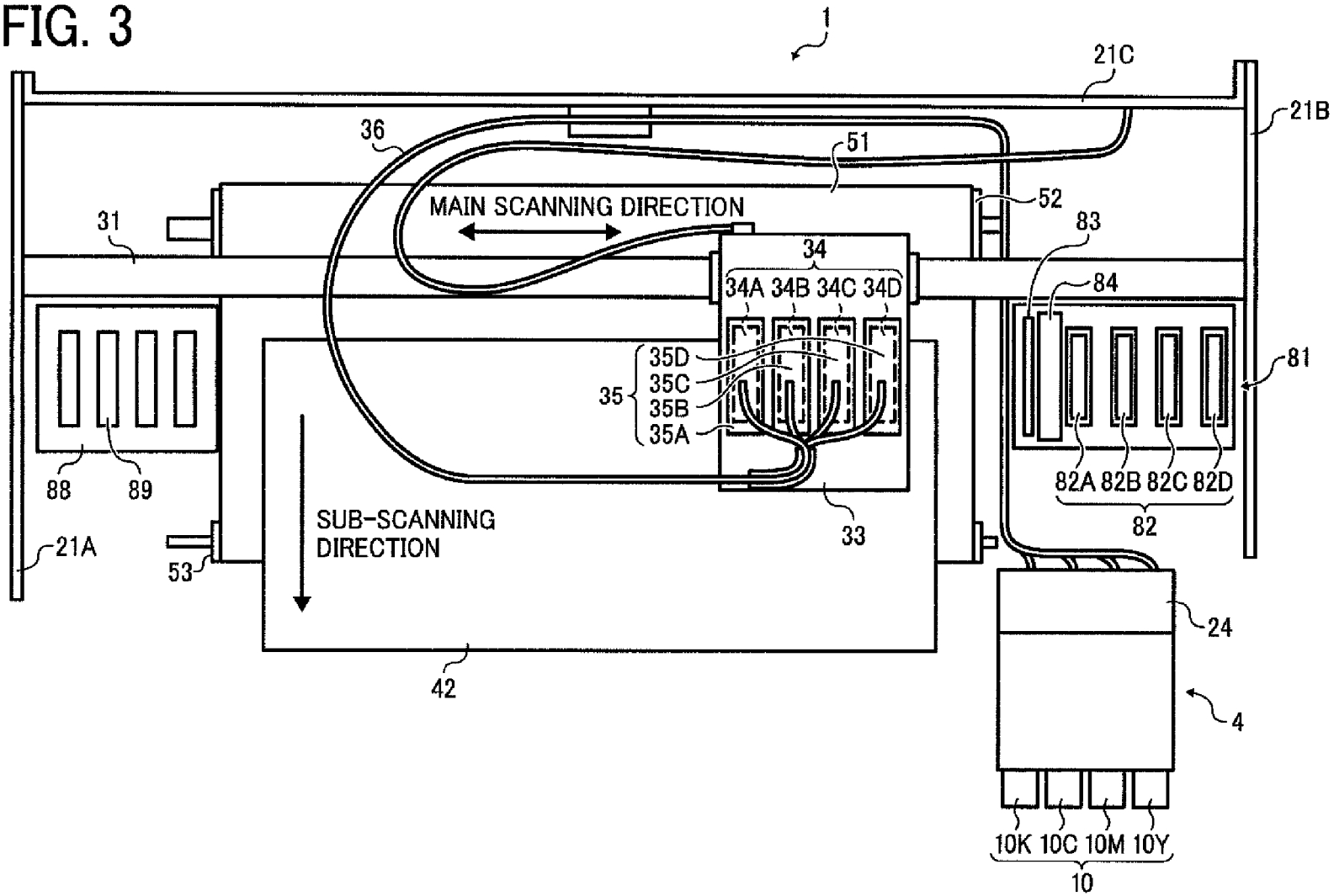
FIG. 3 is a plan view of the image forming device of FIG. 2.

Referring now to the drawings, wherein like reference numerals designate identical or corresponding parts throughout the several views, in particular to FIGS. 1 to 3, an image forming apparatus 100 according to an example embodiment is explained.

FIG. 1 is a perspective front view of the image forming apparatus 100. FIGS. 2 and 3 are views for explaining detailed descriptions are given of the image forming device 1 of the image forming apparatus 100 of FIG. 1. FIG. 2 is a side view illustrating a schematic structure of the image forming device 1, and FIG. 3 is a plan view of the image forming device 1 of FIG. 2.

The image forming apparatus 100 includes an image forming device 1, a paper tray 2, an output tray 3, a cartridge holder 4, an operation display part 5, a front cover 6, and ink cartridges 10.

The image forming apparatus 100 further includes a feed roller 43, a separation pad 44, a guide 45, a counter roller 46, a conveyance guide 47, a pressing member 48, a conveyance belt 51, a conveyance roller 52, a tension roller 53, a charging roller 56, a separator 61, output rollers 62 and 63, a duplex unit 71, and a bypass tray 72.

The image forming device 1 includes a left side plate 21A, a right side plate 21B, a back side plate 21C, a guide rod 31, a stay 32, a carriage 33, recording heads 34, head tanks 35, supply tubes 36, a maintenance-restoration mechanism 81, and an ink collection unit 88.

The recording heads 34 include recording heads 34A, 34B, 34C, and 34D. The head tanks 35 include head tanks 35A, 35B, 35C, and 35D.

The pressing member 48 includes a leading edge pressing roller 49 (depicted in FIG. 2).

The maintenance-restoration mechanism 81 includes caps 82, a wiper blade 83, and a preliminarily discharged droplet receiver 84. The caps 82 include caps 82A, 82B, 82C, and 82D. The ink collection unit 88 includes openings 89.

As illustrated in FIG. 1, the paper tray 2 is attached to the image forming device 1 to load papers thereon to feed to the image forming device 1. The paper tray 2 includes a sheet loading portion 41 (depicted in FIG. 2).

The output tray 3 is detachably attachable to the image forming device 1 of the image forming apparatus 100 to stock output papers on each of which an image is recorded or formed. The cartridge holder 4 is disposed on one end portion on a front surface of the image forming device 1, adjacent to the paper tray 2 and the output tray 3, and holds ink containers or ink cartridges that contain ink as liquid for recording. The operation display part 5 having operation buttons and displays is arranged on a top surface of the cartridge holder 4.

The ink cartridges 10 function as main tanks and are provided in the cartridge holder 4. The ink cartridges 10 include ink cartridges 10K, 10C, 10M, and 10Y in which black, cyan, magenta, and yellow recording liquids or inks are contained, respectively. The ink cartridges 10 can be loaded by pushing from a front side to a back side of the image forming device 1. The front cover or cartridge cover 6 is mounted on the front surface side of the cartridge holder 4 to open and close when the ink cartridges 10 are attached to or detached from the image forming device 1.

The image forming apparatus 100 can be any of a copier, a printer, a facsimile machine, a plotter, and a multifunction printer including at least one of copying, printing, scanning, plotter, and facsimile functions. In this non-limiting example embodiment, the image forming apparatus 200 functions as a serial-type printer for discharging liquid (e.g., ink or an ink droplet) to form an image on a recording medium (e.g., a recording sheet).

As illustrated in FIG. 2, the guide rod 31 and the stay 31 serve as guide members for guiding the carriage 33. For example, the guide rod 31 and the stay 32 support the carriage 33 in such a manner that the carriage 33 slides and moves on the guide rod 31 and the stay 32 in a main scanning direction. A main scanning motor, not shown, moves the carriage 33 via a timing belt in the main scanning direction as shown in a bidirectional arrow in FIG. 3.

The recording heads 34A, 34B, 34C, and 34D are mounted on the carriage 33 and serve as liquid discharging heads for discharging yellow, cyan, magenta, and black ink droplets, respectively. In each of the recording heads 34A, 34B, 34C, and 34D, two nozzle rows, each of which is formed of multiple nozzles, extend in a sub-scanning direction perpendicular to the main scanning direction, so that the multiple nozzles discharge ink droplets downward.

The recording heads 34A, 34B, 34C, and 34D includes respective nozzle rows for discharging yellow, cyan, magenta, and black ink droplets, respectively. Alternatively, the image forming apparatus 100 may include two recording heads with two nozzle rows for each for discharging yellow, cyan, magenta, and black ink droplets, in given combination. For example, in one recording head, one nozzle row discharges black ink droplets and another nozzle row discharges cyan ink droplets. In the other recording head, one nozzle row discharges magenta ink droplets and another nozzle row discharges yellow ink droplets. Yet alternatively, the image forming apparatus 100 may include a single recording head in which four nozzle rows, each of which includes multiple nozzles, discharge yellow, cyan, magenta, and black ink droplets, respectively.

An inkjet head forming a head of each of the recording heads 34 may include a pressure generator for generating pressure to compress ink contained in a pressing liquid chamber, such as a piezoelectric actuator, a thermal actuator, a shape-memory-alloy actuator, a static actuator. The piezoelectric actuator includes piezoelectric elements. The thermal actuator uses phase changes due to liquid film boiling with electrothermal conversion elements such as heat resistance elements. The shape-memory-alloy actuator uses metal phase change due to temperature changes. The static actuator uses static electricity.

The head tanks 35 including the head tanks 35A, 35B, 35C, and 35D are mounted on the carriage 33 and correspond to the nozzle rows of the recording heads 34A, 34B, 34C, and 34D to supply inks in corresponding colors to the recording heads 34A, 34B, 34C, and 34D. The ink cartridges 10K, 10C, 10M, and 10Y contain black, cyan, magenta, and yellow inks, respectively.

Alternatively, the image forming apparatus 100 may include six head tanks with nozzle rows for each for discharging ink droplets in an order of yellow, magenta, black, cyan, magenta, and yellow for the purpose of preventing color change between an original image and a printed image based on the original image.

The cartridge holder 4 (depicted in FIG. 1) further includes a supply pump unit 24 that supplies the black, cyan, magenta, and yellow inks from the ink cartridges 10K, 10C, 10M, and 10Y to the head tanks 35A, 35B, 35C, and 35D via the supply tubes 36, respectively.

As illustrated in FIG. 2, in the paper tray 2, the sheet loading portion 41 (e.g., a pressure plate) loads sheets 42. The feed roller 43, having a half-moon-like shape, separates a sheet 42 from other sheet 42 loaded on the sheet loading portion 41 and feeds the separated sheet 42 toward the guide 45. The separation pad 44 opposes the feed roller 43 and includes a material having an increased friction coefficient. The separation pad 44 is pressed against the feed roller 43. The feed roller 43 and the separation pad 44 serve as a sheet supplier.

The guide 45 guides the sheet 42 fed by the sheet supplier toward the counter roller 46. The counter roller 46 feeds the sheet 42 toward the conveyance guide 47. The conveyance guide 47 guides the sheet 42 toward the pressing member 48. The leading edge pressing roller 49 of the pressing member 48 presses the sheet 42 against the conveyance belt 51. The conveyance belt 51 serves as a conveyer that conveys the sheet 42 to electrostatically attract the sheet 42 at a position opposing the recording heads 34. Thus, the sheet 42 fed by the sheet supplier is sent to a position under the recording heads 34.

The conveyance belt 51, having an endless loop belt-like shape, is looped over the conveyance roller 52 and the tension roller 53 to rotate in a direction of rotation R (e.g., a sub-scanning direction). The charging roller 56 serves as a charger for charging a surface of the conveyance belt 51. The charging roller 56 contacts a surface layer of the conveyance belt 51 and is driven and rotated by rotation of the conveyance belt 51.

A sub-scanning motor, not shown, drives and rotates the conveyance roller 52 via a timing belt so that the conveyance roller 52 rotates the conveyance belt 51 in the direction of rotation R as indicated by arrow shown in FIG. 3.

The separator 61 and the output rollers 62 and 63 serve as an output device for discharging the sheet 42 bearing an image formed by the recording heads 34. For example, the separator 61 separates the sheet 42 from the conveyance belt 51. The output rollers 62 and 63 discharge the sheet 42 onto the output tray 3 provided under the output roller 62.

The duplex unit 71 is detachably attachable to a rear portion of the image forming apparatus 100. The duplex unit 71 receives the sheet 42 fed by the conveyance belt 51 rotating backward, reverses the sheet 42, and feeds the sheet 42 toward a nip portion formed between the counter roller 46 and the conveyance belt 51. A top surface of the duplex unit 71 serves as the bypass tray 72.

As illustrated in FIG. 3, the maintenance-restoration mechanism 81 is disposed in a non-printing region provided in one end of the image forming device 1 in the main scanning direction in which the carriage 33 moves. The maintenance-restoration mechanism 81 serves as a maintenance-restoration device for maintaining and restoring a condition of the nozzles of the recording heads 34. In the maintenance-restoration mechanism 81, the caps 82A, 82B, 82C, and 82D cap nozzle surfaces of the recording heads 34A, 34B, 34C, and 34D, respectively. The cap 82A serves as a vacuum and wetting cap and the caps 82B, 82C, and 82D serve as a wetting cap. The wiper blade 83 wipes the nozzle surfaces of the recording heads 34. The preliminarily discharged droplet receiver 84 receives ink droplets discharged preliminarily and thereby not used for forming an image on the sheet 42 to discharge ink droplets having an increased viscosity.

As illustrated in FIG. 3, the ink collection unit 88 (e.g., a preliminarily discharged droplet receiver) is disposed in another non-printing region provided in another end of the image forming device 1 in the main scanning direction in which the carriage 33 moves. The ink collection unit 88 serves as a liquid collection container for receiving ink droplets discharged preliminarily and thereby not used for forming an image on the sheet 42 to discharge ink droplets having an increased viscosity during an image forming operation and the like. In the ink collection unit 88, the openings 89 are arranged along the nozzle rows of the recording heads 34.

Referring to FIG. 1, the following describes an image forming operation performed in the image forming apparatus 100 having the above-described structure. The feed roller 43 and the separation pad 44 feed sheets 42 loaded on the paper tray 2 one by one upward toward the guide 45. The guide 45 guides the sheet 42 in a substantially vertical direction toward the nip portion formed between the counter roller 46 and the conveyance belt 51. The counter roller 46 and the conveyance belt 51 nip the sheet 42 and feed the sheet 42 toward the conveyance guide 47. The conveyance guide 47 guides a leading edge of the sheet 42 toward the leading edge pressing roller 49. The leading edge pressing roller 49 presses the sheet 42 against the conveyance belt 51 so that the conveyance belt 51 turns a sheet conveyance direction of the sheet 42 by about 90 degrees.

When conveyance belt 51 turns the sheet conveyance direction of the sheet 42, the conveyance belt 51 attracts the sheet 42, and the rotating conveyance belt 51 conveys the sheet 42 in the sub-scanning direction.

While the carriage 33 moves, the recording heads 34 are driven according to an image signal. For example, the recording heads 34 discharge ink droplets onto the sheet 42 stopped on the conveyance belt 51 to form an image of one line. After the conveyance belt 51 conveys the sheet 42 for a given amount, the recording heads 34 form an image of a next one line. When the recording heads 34 receive an image formation completion signal or a signal indicating that a trailing edge of the sheet 42 reaches an image forming region, the image forming operation is finished, and the sheet 42 is output onto the output tray 3.

Figure 4:
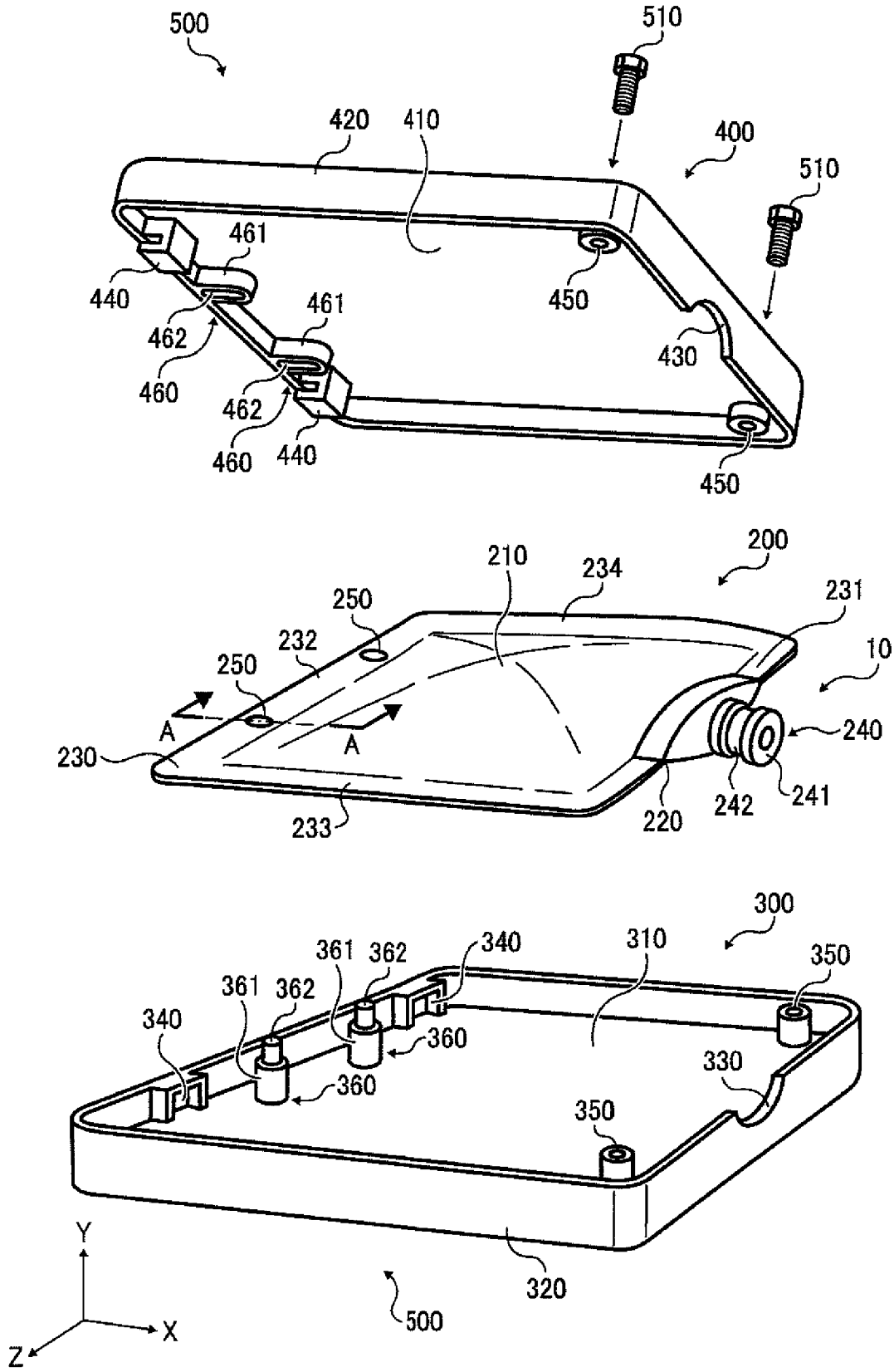
FIG. 4 is an exploded perspective view illustrating of an ink cartridge incorporated in the image forming apparatus of FIG. 1.
Figure 5:
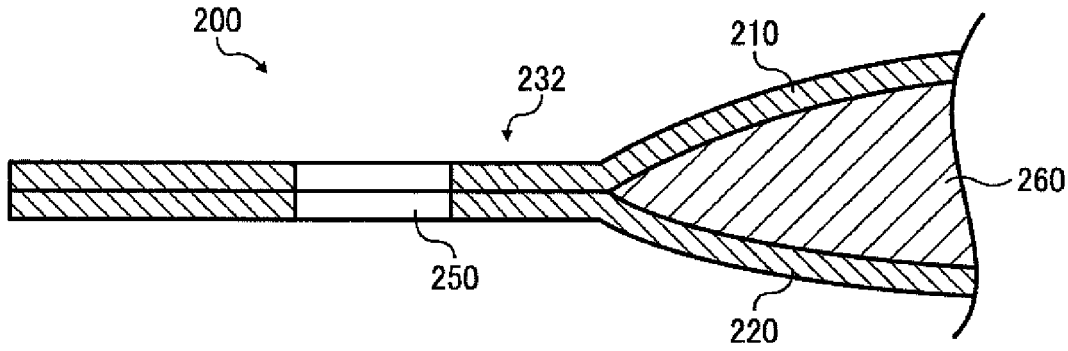
FIG. 5 is a cross-sectional view of the ink cartridge of FIG. 4, taken along A-A line of FIG. 4.

Referring to FIGS. 4 and 5, descriptions are given of the ink cartridge 10.

FIG. 4 is an exploded perspective view illustrating of the ink cartridge 10 and FIG. 5 is a cross-sectional view of the ink cartridge 10 shown in FIG. 4, taken along A-A line of FIG. 4.

The ink cartridge 10 that serves as an ink liquid holder includes an ink pack 200 and a case 500.

The ink pack 200 contains liquid ink therein, and includes laminating films 210 and 220, a perimeter 230, an ink supply opening 240, and two holes 250.

The perimeter 230 includes four edges 231, 232, 233, and 234.

The ink supply opening 240 includes a tube part 241 and a groove 242.

The case 500 accommodates the ink pack 200 therein, and includes a base part 300 and a cover part 400.

The base part 300 includes a bottom face 310, a side face 320, an engaging part 330, two claw stoppers 340, two screw holes 350, and two projecting parts 360. The two projecting parts 360 have respective basal parts 361 and stand parts 362.

The cover part 400 includes a top face 410, a side face 420, an engaging part 430, two claws 440, two screw holes 450, and two recessed parts 460. The two recessed parts 460 are slot-shaped and have respective basal parts 461 and two hollow parts 462.

As illustrated in FIG. 4, the laminating films 210 and 220 are flexible and rectangular shaped sheets, and the perimeter 230 is arranged around the laminating films 210 and 220. The perimeter 230 of the laminating films 210 and 220 are welded to form the ink pack 200 for containing liquid ink 260 therein. The perimeter 230 includes four edges 231, 232, 233, and 234. The edge 231 forms a short line on which the ink supply opening 240 made of polyethylene resin is mounted. The tube part 241 of the ink supply opening 240 is cylindrical shaped and has the groove 242 formed therearound.

The edge 232 is arranged to face the edge 231 and forms the two holes 250 thereon, as illustrated in FIGS. 4 and 5.

As illustrated in FIG. 4, the base part 300 and the cover part 400 are connected to form a substantially cubic box so as to contain the ink pack 200 inside the case 500. The base part 300 and the cover part 400 can be made of polyethylene resin, for example.

The bottom face 310 is rectangular shaped, and the side face 320 stands vertically on the bottom face 310.

The engaging part 330 is formed in a recessed manner on the side face 320 to receive the groove 242 of the ink supply opening 240 of the ink pack 200 so that the tube part 241 can be disposed in a projecting manner.

The two claw stoppers 340 connect the cover part 400 with the base part 300.

The two screw holes 350 are formed for internal thread to receive two screws 510.

The stand parts 362 having a cylindrical shape are formed on the respective basal parts 361 having a larger diameter of a cylindrical shape. Such projecting parts 360 are inserted to the corresponding recessed parts 460 through the holes 250 of the ink pack 200.

The top face 410 is rectangular shaped, and the side face 420 stands vertically on the top face 410. The side face 320 and the side face 420 are connected so that the bottom face 310 and the top face 410 are disposed to face each other.

The engaging part 430 is formed in a recessed manner on the side face 420 to receive the groove 242 of the ink supply opening 240 of the ink pack 200 so that the tube part 241 can be disposed in a projecting manner.

The claws 440 are engaged with the respective claw stoppers 340 of the base part 300 by sliding and fitting the cover part 400 to the base part 300 in a direction X indicated in FIG. 4. By so doing, the cover part 400 is fixedly engaged with the base part 300.

The screw holes 450 are formed to allow the two screws 510 to be inserted therethrough.

The recessed parts 460 have an elongate hole or a slotted hole into which the projecting parts 360 are inserted via the holes 250 formed on the ink pack 200.

The basal parts 461 of the recessed parts 460 have an elongate hole or a slotted hole and formed in a row on the top face 410 and the side face 420. The hollow parts 462 of the recessed parts 460 with an elongate hole or a slotted hole are formed on the respective basal parts 461 to receive the stand parts 362 of the projecting parts 360 are inserted thereto. The hollow parts 462 of the recessed parts 460 are formed to extend in an identical direction so that the cover part 400 is slidably fitted to the base part 300 in the direction X in FIG. 4.

To fit the base part 300 and the cover part 400 together, the claws 440 are slidably moved toward the claw stoppers 340 corresponding to the claws 440 in the direction X in FIG. 4 so that the base part 300 and the cover part 400 can be positioned in directions Y and Z in FIG. 4. The two screws 510 are then inserted into the screw holes 450 and the screw holes 350 to fix the base part and the cover part 400 to each other. Since the hollow parts 462 serve as long holes extending in the direction X, the base part 300 and the cover part 400 can slidably move in the direction X while the stand parts 362 are inserted into the hollow parts 462, so as to engage the claws 440 and the claw stoppers 340.

Before fitting the base part 300 and the cover part 400, the ink pack 200 is placed between the base part 300 and the cover part 400. The groove 242 of the ink supply opening 240 is sandwiched between the engaging part 330 of the base part 300 and the engaging part 430 of the cover part 400. The stand parts 362 of the projecting parts 360 are inserted into the holes 250 formed on the edge 232, and is then inserted into the hollow parts 462 of the recessed parts 460. By so doing, the edge 232 of the ink pack 200 is fixedly held in the vicinity of the holes 250 between the basal parts 361 of the projecting parts 360 and the basal parts 461 of the recessed parts 460, and therefore the ink pack 200 is surely held.

As described above, in the ink cartridge 10 according to an example embodiment of this patent specification, the ink pack 200 are held by the base part 300 and the cover part 400 at the ink supply opening 240 and the edge 232, which may not cause ink leakage due to drop impact. Therefore, the ink cartridge 10 according to an example embodiment of this patent specification can provide high resistance to impact and contain a large amount of ink. Further, the base part 300 and the cover part 400 of the ink cartridge 10 according to an example embodiment of this patent specification can be easily disassembled by unscrewing the screws 510, and the ink pack 200 can be easily removed. Accordingly, the ink cartridge 10 according to an example embodiment of this patent specification can provide high reusability.

In the above-described example embodiment, these two holes 250 are formed on the ink pack 200 to fix to the base part 300 and the cover part 400. However, any number of holes other than the two holes 250 can be formed on the ink pack 200.

Figure 6:
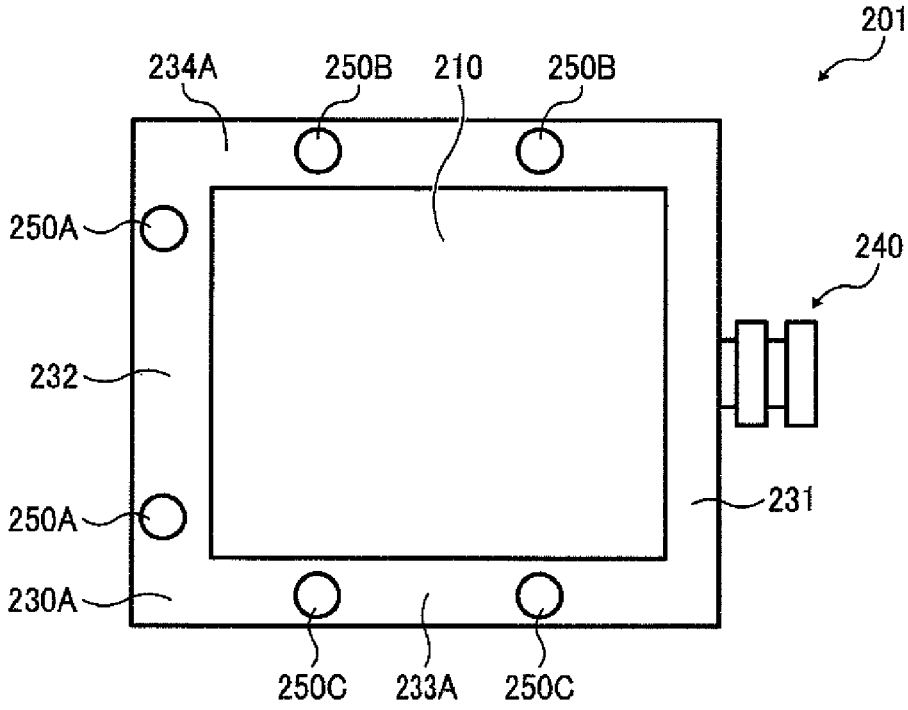
FIG. 6 is a plan view illustrating an ink pack included in the ink cartridge.

Referring to FIG. 6, a description is given of an ink pack 201 according to another example embodiment of this patent specification.

FIG. 6 is a plan view illustrating the ink pack 201. Elements or parts of the ink pack 201 according to this example embodiment may be denoted by the same reference numerals as those of the ink pack 200 according to the above-described example embodiment and the descriptions thereof are omitted or summarized.

As illustrated in FIG. 6, the ink pack 201 of this example embodiment includes a perimeter 230A having four edges 231, 232, 233A, and 234A. The edge 231 forms a short line on which the ink supply opening 240 is mounted. The edges 232, 233A, and 234A form holes 250A, 250B, and 250C, respectively. The base part 300 and the cover part 400 of the ink pack 201 form projecting parts and recessed parts, respectively, to correspond to the holes 250A, 250B, and 250C, through which the projecting parts and the recessed parts are engaged.

With the above-described structure, the ink pack 201 according to this example embodiment can achieve a higher resistance to impact for the ink cartridge 10.

Figure 7:
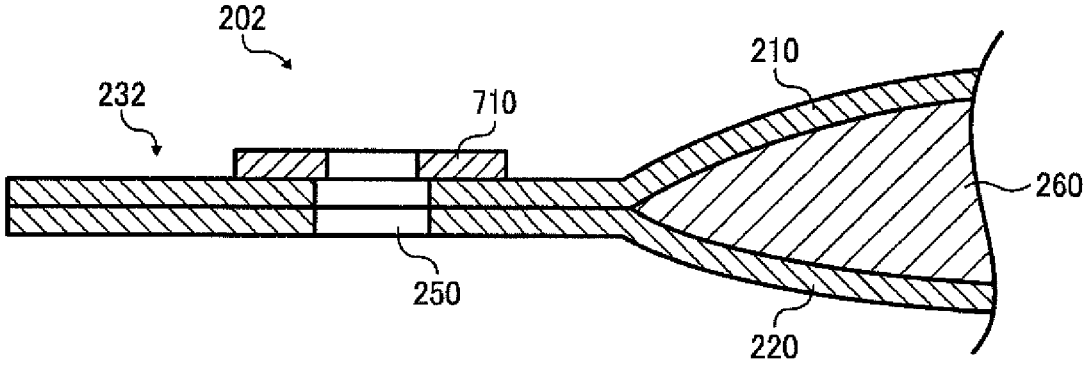
FIG. 7 is a cross-sectional view of an ink pack according to an example embodiment of this patent specification.

Referring to FIG. 7, a description is given of an ink pack 202 according to another example embodiment of this patent specification.

FIG. 7 is a cross-sectional view of the ink pack 202 according to an example embodiment of this patent specification. Elements or parts of the ink pack 202 according to this example embodiment may be denoted by the same reference numerals as those of the ink pack 200 according to the above-described example embodiment and the descriptions thereof are omitted or summarized.

The ink pack 202 shown in FIG. 7 includes a reinforcing member 710 to reinforce holes formed on the ink pack 202 for higher resistance to impact to the ink cartridge 10.

As illustrated in FIG. 7, the reinforcing member 710 has an annular plate shape and is mounted in the vicinity of the hole 250 formed on the edge 232 of the upper laminating film 210, which is adhered to the lower laminating film 220 to form the ink pack 202.

Since the hole 250 is reinforced with the reinforcing member 710 in the above-described structure, the ink pack 202 according to this example embodiment can achieve a higher resistance to impact for the ink cartridge 10.

Figure 8:
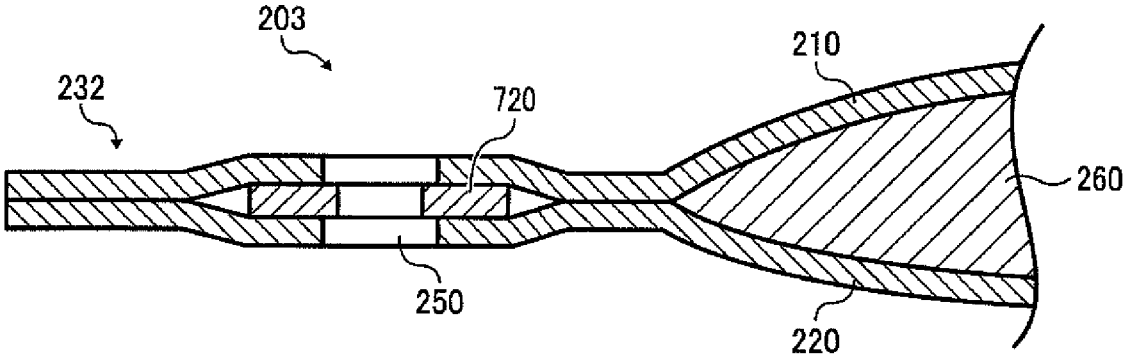
FIG. 8 is a cross-sectional view of an ink pack according to an example embodiment of this patent specification.

Referring to FIG. 8, a description is given of an ink pack 203 according to another example embodiment of this patent specification.

FIG .8 is a cross-sectional view of the ink pack 203 according to an example embodiment of this patent specification. Elements or parts of the ink pack 203 according to this example embodiment may be denoted by the same reference numerals as those of the ink pack 200 according to the above-described example embodiment and the descriptions thereof are omitted or summarized.

The ink pack 203 shown in FIG. 8 includes a reinforcing member 720 to reinforce holes formed on the ink pack 203 for higher resistance to impact to the ink cartridge 10.

As illustrated in FIG. 8, the reinforcing member 720 has an annular plate shape and is sandwiched between the holes 250 formed on the edges 232 of the upper laminating film 210 and the lower laminating film 220, which are adhered to each other to form the ink pack 203.

Since the hole 250 is reinforced with the reinforcing member 720 in the above-described structure, the ink pack 203 according to this example embodiment can achieve a higher resistance to impact for the ink cartridge 10.

The exemplary embodiments of the present patent specification are explained. However, the present patent specification in its broader aspects is not limited to the specific details and representative embodiments shown and described herein. Accordingly, various modifications may be made without departing from the spirit or scope of the general inventive concept as defined by the appended claims and their equivalents.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of the present patent specification may be practiced otherwise than as specifically described herein.

Obviously, numerous modifications and variations of the present patent specification are possible in light of the above teachings. It is therefore to be understood that within the scope of the appended claims, the present patent specification may be practiced otherwise than as specifically described herein.

This patent specification claims priority from Japanese patent application No. 2008-104347 filed on Apr. 14, 2008 in the Japan Patent Office, the entire contents and disclosures of which are hereby incorporated by reference herein in their entirety.

What is claimed is:

1. An ink container, comprising:

an ink pack formed by adhering perimeters of multiple flexible films together to contain ink therein, the ink pack having at least one hole formed in a perimeter thereof; and a case to hold the ink pack therein, formed by fitting together multiple members, a first member of the multiple members having a projecting portion insertable into the at least one hole formed in the ink pack, a second member of the multiple members having a recessed portion with a slot shape elongated in a longitudinal direction of the case, the multiple members being fit together by slidably moving the projecting portion mounted on the first member in the recessed portion arranged on the second member in the longitudinal direction of the case.

2. The ink container according to claim 1, wherein the ink pack includes multiple edges on the perimeter, a first edge of the multiple edges having an opening therein to discharge ink, a second edge of the multiple edges having the hole therein, the projecting portion of the first member of the case and the recessed portion of the second member of the case formed on positions corresponding to the hole formed in the second edge of the ink pack.

3. The ink container according to claim 2, wherein the multiple edges of the ink pack include four edges, the first edge having the opening and the second edge having the hole disposed facing each other.

4. The ink container according to claim 1, further comprising a reinforcing member having an annular plate shape, being disposed on an upper film of the flexible films on the perimeter in the vicinity of the hole of the ink pack.

5. The ink container according to claim 1, further comprising a reinforcing member having an annular plate shape, being sandwiched between the flexible films on the perimeter of the hole of the ink pack.

6. The ink container according to claim 1, wherein the first member of the multiple members further includes a bottom face that is rectangular shaped and includes four edges, and a side face that stands vertically from the edges of the bottom face.

7. The ink container according to claim 1, wherein the first member of the multiple members further includes a side face including four side walls that form a rectangular shape, a first side wall of the four side walls includes claw stoppers facing towards an opposite side wall on an opposite side of the rectangular shape from the first side wall, and the opposite wall includes an engaging part shaped to accommodate an ink supply opening of the ink pack.

8. The ink container according to claim 1, wherein the first member of the multiple member further includes a side face including four side walls that form a rectangular shape, a first side wall of the four side walls including claw stoppers facing towards an opposite side wall on an opposite side of the rectangular shape from the first side wall, and the opposite wall including an engaging part shaped to accommodate an ink supply opening of the ink pack, and wherein the projecting portion is (i) located closer to the opposite wall than the claw stoppers are and (ii) apart from the side face and the claw stoppers.

9. The ink container according to claim 1, wherein the second member of the multiple members further includes claws corresponding to claw stoppers located on the first member, the claw stoppers being shaped to receive the claws of the second member, and wherein the claws and the corresponding claw stoppers are fit together by slidably moving the claws of the second member toward the claw stoppers of the first member in a direction in which ink is supplied from an ink supply opening of the ink pack, causing the second member to be fixedly engaged with the first member.

10. The ink container according to claim 1, wherein the second member of the multiple members further includes claws corresponding to claw stoppers located on the first member, the claw stoppers being shaped to receive the claws of the second member, and wherein the claws and the corresponding claw stoppers are fit together by slidably moving the claws of the second member toward the claw stoppers of the first member in the longitudinal direction of the case, causing the second member to be (i) fixedly engaged with the first member and (ii) aligned with the first member in directions orthogonal to the longitudinal direction of the case.

11. The ink container according to claim 1, wherein the second member of the multiple members further includes claws corresponding to claw stoppers located on the first member, the claw stoppers being shaped to receive the claws of the second member, and wherein the recessed portion of the second member allows the claws of the second member to slide into the claw stoppers of the first member while the projecting portion is inserted into the recessed portion.

12. The ink container according to claim 1, wherein the first member of the multiple members further includes a side face that forms a rectangular shape, and wherein the perimeters of the ink pack are not in contact with the side face of the first member while the ink pack is in the case.

13. An image forming apparatus, comprising:

an ink container including:

an ink pack formed by adhering perimeters of multiple flexible films together to contain ink therein, the ink pack having at least one hole formed in a perimeter thereof; and a case to hold the ink pack therein, formed by fitting together multiple members, wherein a first member of the multiple members has a projecting portion insertable into the at least one hole formed in the ink pack, a second member of the multiple members has a recessed portion with a slot shape elongated in a longitudinal direction of the case, and the multiple members are fit together by slidably moving the projecting portion mounted on the first member in the recessed portion arranged on the second member in the longitudinal direction of the case; and a cartridge holder holding the ink container.

* * * * *